US008333284B2

(12) United States Patent
Berry et al.

(10) Patent No.: US 8,333,284 B2
(45) Date of Patent: Dec. 18, 2012

(54) CLIP FOR CONVERTIBLE CARD ROW

(75) Inventors: Todd E. Berry, Kansas City, MO (US); Shaun P. Arness, Shawnee, KS (US)

(73) Assignee: Hallmark Cards, Incorporated, Kansas City, MO (US)

( * ) Notice: Subject to any disclaimer, the term of this patent is extended or adjusted under 35 U.S.C. 154(b) by 0 days.

(21) Appl. No.: 13/188,701

(22) Filed: Jul. 22, 2011

(65) Prior Publication Data

US 2011/0272374 A1 Nov. 10, 2011

Related U.S. Application Data

(63) Continuation of application No. 12/347,111, filed on Dec. 31, 2008, now Pat. No. 8,132,679.

(51) Int. Cl.
*A47F 7/14* (2006.01)

(52) U.S. Cl. ..... 211/55

(58) Field of Classification Search ..... 211/59.3, 211/104, 105, 201, 202, 7, 94.01, 106.01, 211/55, 52, 51, 50, 54.1, 184, 128.1, 150, 211/43, 119.003; 40/642.01, 642.02, 124.01, 40/124.06; 248/316.7, 289.11, 290.1, 229.16, 248/229.26

See application file for complete search history.

(56) References Cited

U.S. PATENT DOCUMENTS 965,019 A 7/1919 Schandein
3,023,907 A 3/1962 Herman
3,139,186 A 6/1964 George
3,285,424 A 11/1966 Emery et al.
3,298,538 A 1/1967 Ganz
3,497,081 A * 2/1970 Field ..... 211/184
3,501,019 A * 3/1970 Armstrong et al. ..... 211/184
(Continued)

OTHER PUBLICATIONS

Non-Final Office Action dated Sep. 22, 2011 (U.S. Appl. No. 12/347,111).

(Continued)

*Primary Examiner* — Jennifer E. Novosad
(74) *Attorney, Agent, or Firm* — Shook, Hardy & Bacon L.L.P.

(57) ABSTRACT

When displayed, greeting cards are typically organized on a display fixture having multiple rows or levels upon which to sit the cards. Each row then has a front wall to hold in the card, yet is short enough to still view a portion of the greeting card above the wall. Because display fixtures are manufactured to have a specified amount of rows or levels at a specified depth, in order to adjust the specifications of a display fixture, other pieces may be used, for example, by attaching to the display fixture a convertible row to add another level or tier between set rows of the display fixture. By providing another row using a convertible row, another set of greeting cards may be displayed between cards displayed on other rows of the original display fixture, increasing the density of the overall display. Further, when an extra row is not desired, such a convertible row may be pushed flush against the back of the display fixture, while still attached, allowing the full depth of the row of the display fixture to be used. To support the convertible row when in use, a divider or support clip is provided. The divider clip may both separate greeting cards within a row of the display fixture and support a convertible row adjacent thereto. The divider clip includes a clipping mechanism to attach the divider clip to the display fixture and an adjustable portion capable of adjusting itself to support an adjacent convertible row.

12 Claims, 6 Drawing Sheets

U.S. PATENT DOCUMENTS

| | | | | | |
|---|---|---|---|---|---|
| 3,559,815 | A | * | 2/1971 | Huddleston | 211/184 |
| 3,612,292 | A | * | 10/1971 | Nervig | 211/184 |
| 3,698,568 | A | * | 10/1972 | Armstrong | 211/184 |
| 3,703,964 | A | * | 11/1972 | Field | 211/184 |
| 3,892,378 | A | * | 7/1975 | Lane | 248/71 |
| 3,893,739 | A | * | 7/1975 | Bernard | 312/321.5 |
| 3,995,921 | A | | 12/1976 | Ackeret | |
| 4,395,955 | A | * | 8/1983 | Pfeifer | 108/61 |
| 4,606,464 | A | * | 8/1986 | Jordan et al. | 211/41.8 |
| 4,768,661 | A | * | 9/1988 | Pfeifer | 211/184 |
| 4,796,764 | A | * | 1/1989 | Hardy | 211/184 |
| 4,809,856 | A | * | 3/1989 | Muth | 211/184 |
| 4,905,845 | A | | 3/1990 | Broeker | |
| 5,014,859 | A | | 5/1991 | Johnson | |
| 5,101,987 | A | | 4/1992 | Twedt | |
| 5,184,737 | A | | 2/1993 | Hardy | |
| 5,228,578 | A | * | 7/1993 | Wu | 211/43 |
| 5,269,600 | A | * | 12/1993 | Arreola et al. | 312/348.3 |
| 5,284,337 | A | | 2/1994 | Ettischer et al. | |
| 5,346,298 | A | * | 9/1994 | Headley | 312/348.3 |
| 5,474,190 | A | * | 12/1995 | Won-Kim | 211/41.12 |
| 5,765,390 | A | * | 6/1998 | Johnson et al. | 62/441 |
| 6,003,690 | A | * | 12/1999 | Allen et al. | 211/51 |
| 6,044,982 | A | * | 4/2000 | Stuart | 211/43 |
| 6,082,558 | A | | 7/2000 | Battaglia | |
| 6,116,433 | A | | 9/2000 | Pursall | |
| 6,412,648 | B1 | | 7/2002 | Woolnough et al. | |
| 6,612,052 | B2 | | 9/2003 | Sawchuk | |
| 6,793,185 | B2 | * | 9/2004 | Joliey | 248/220.21 |
| 6,880,903 | B2 | * | 4/2005 | O'Halloran et al. | 312/407 |
| 6,955,268 | B2 | | 10/2005 | Waldron | |
| 7,128,220 | B2 | | 10/2006 | Baitz | |
| 7,775,379 | B2 | | 8/2010 | Hodge | |
| 7,913,862 | B2 | | 3/2011 | Collins et al. | |
| 7,934,609 | B2 | * | 5/2011 | Alves et al. | 211/59.2 |
| 7,987,999 | B2 | | 8/2011 | Welgand et al. | |
| 2003/0106867 | A1 | | 6/2003 | Caterinacci | |
| 2010/0078402 | A1 | * | 4/2010 | Davis et al. | 211/184 |

OTHER PUBLICATIONS

Australian Office Action dated Feb. 11, 2011 (re Australian App. 2009243452).

European Search Report dated Dec. 7, 2010 (App. No. EP 09177196).

* cited by examiner

CLIP FOR CONVERTIBLE CARD ROW

CROSS-REFERENCE TO RELATED APPLICATIONS

The present application is a divisional of pending U.S. application Ser. No. 12/347,111, entitled "CONVERTIBLE CARD ROW", filed Dec. 31, 2008.

STATEMENT REGARDING FEDERALLY SPONSORED RESEARCH OR DEVELOPMENT

Not applicable.

BRIEF SUMMARY OF THE INVENTION

When displayed, greeting cards are typically organized on a display fixture that has multiple rows or levels upon which to sit the cards. Each row may have a front piece that holds in the card, yet is transparent or short enough to still view at least a portion of the greeting card. Because display fixtures are manufactured to have a specified amount of rows or levels at a specified depth, in order to adjust the specifications of a display fixture, other pieces must be used, for example, attaching a separate divider to the display fixture to add another level or tier between a set row of the display fixture. By providing another row using a dividing piece, another set of greeting cards may be displayed between cards already displayed on adjacent rows of the original display fixture, thereby increasing the density of the overall display. However, when an extra row is not desired, the dividing piece must be removed from the display fixture and stored elsewhere. This presents problems with storage and may result in a loss of the divider.

In one embodiment of the present invention, a card assembly apparatus for displaying multiple rows of greeting cards is provided. The apparatus comprises, in part, a display section with a back piece, one or more rows, and one or more front pieces, where a greeting card is placed on a row and portions thereof can be viewed through and/or above the front piece. The apparatus further comprises a collapsible row having a front divider and bottom divider attached at a joint. The joint permits movement of the collapsible row between a use or display position and a storage or non-use position. In the display position, the front divider is pulled out away from the display fixture, such that the bottom divider is perpendicular to the back piece. This allows for a greeting card to be supported for display on the bottom divider. In the storage or non-use position, the joint allows the front divider to be pushed against the back piece, such that the bottom divider is setting against the back piece. The apparatus also includes a divider clip that hooks on the front piece of the display section to separate cards and assist with maintaining the collapsible row in the display position.

In yet another embodiment, a collapsible row for use with a display section for displaying greeting cards is provided. The collapsible row comprises, in part, a front divider, a bottom divider, and a joint connecting the front and bottom dividers. The joint allows the collapsible row to be moved between a display position, where the front divider is pulled out away from a display section such that the bottom divider is perpendicular to the back of the display fixture to allow for a greeting card to be displayed on the bottom divider, and in a non-use position, where the front divider can be pushed against the back of the display section such that the bottom divider is setting against the display section.

In still another embodiment, a divider or support clip for separating greeting cards within a row of a display fixture and supporting a collapsible row is provided, in accordance with an embodiment of the present invention. The divider clip includes, in part, a clipping mechanism to attach the divider clip to the display fixture and an adjustable portion capable of adjusting itself to support a collapsible row used in the display fixture.

BRIEF DESCRIPTION OF THE DRAWINGS

The features of the invention noted above are explained in more detail with reference to the embodiments illustrated in the attached drawing figures, in which like reference numerals denote like elements, in which FIGS. 1-7C illustrate several possible embodiments of the present invention, and in which:

FIG. 1 is a front perspective view of an exemplary card display fixture with a plurality of divider pieces, in accordance with an embodiment of the present invention;

FIG. 2 is a cross-sectional side elevation view of the card display fixture with a plurality of divider pieces of FIG. 1 taken along the line 2-2;

FIG. 5 illustrates a second possible embodiment of a dividing clip of the present invention;

FIGS. 7A-7C illustrate a fourth possible embodiment of a dividing clip of the present invention.

DETAILED DESCRIPTION OF THE INVENTION

Figure 1:
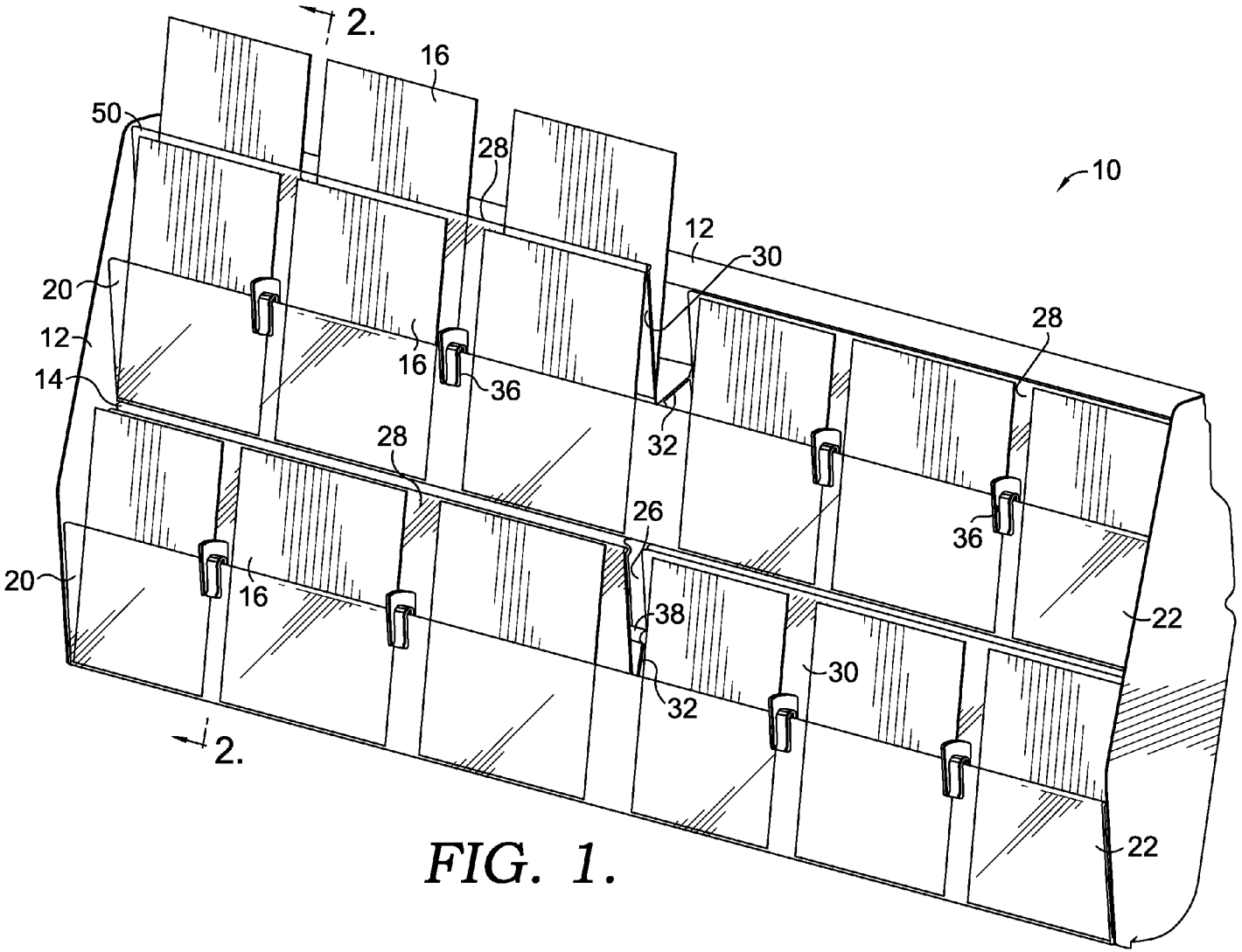
Figure 2:
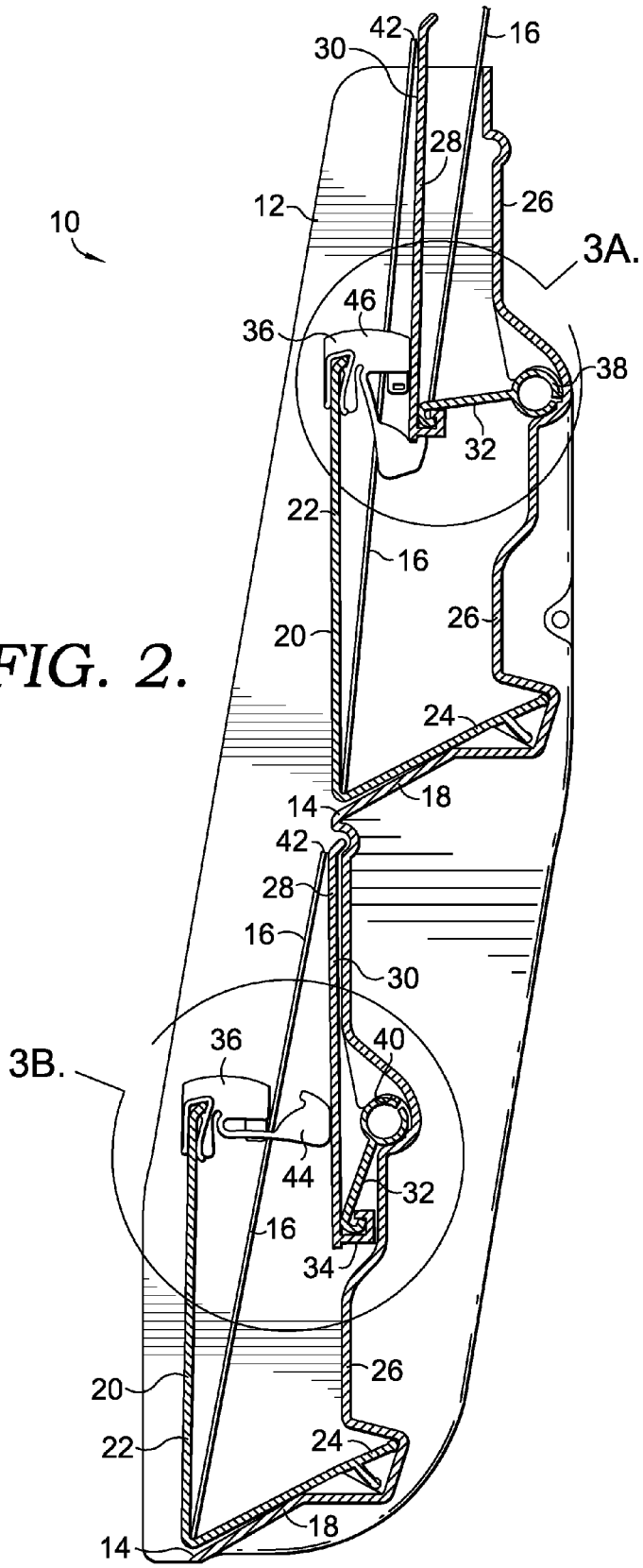

Referring now to the drawings in more detail and initially to FIG. 1, numeral 10 generally designates a card assembly apparatus constructed in accordance with an embodiment of the present invention. In this illustrated example, the apparatus 10 includes a display section or panel or tray 12 for coupling to and support on a display fixture (not shown). The display fixture may be any standard display fixture as is known in the art. As illustrated, the display section 12 includes two permanent levels 14 for displaying greeting cards 16. As illustrated in FIG. 2, each level 14 is defined by a ledge 18, upon which an L-shaped row section 20 is supported. Each row section 20 includes a front wall 22 and a bottom wall 24. Each front wall 22 is of a sufficient height to contain a greeting card 16, while still allowing a portion thereof to be visible above the front wall 22. Though not necessary, the row sections 20, and in particular the front wall 22, are preferably transparent, such that the full face of the cards 16 can be viewable. Each level 14 of the display section 12 also includes a rear wall 26 against which the greeting cards 16 would normally rest. The greeting cards 16 are supported on the bottom wall 24 of the row sections 20.

To provide for the ability to change the display arrangement, the illustrated display section 12 also includes a plurality of convertible rows 28 that are capable of being moved between a use or display position and a storage or non-use position. As illustrated in FIG. 1, the display section 12 includes four convertible rows 28, two to form an upper row and two to form a lower row. Alternatively, single convertible rows 28 could run the width of the display section 12, such that only two convertible rows 28 would be provided. As illustrated, the upper left convertible row 28 is provided in the display position, while the upper and lower right convertible rows 28 are in the storage position. The lower left convertible row 28 has been illustrated in FIG. 1 in a position close to the storage position.

Each convertible row 28 includes a front divider 30 and a bottom divider 32. The front and bottom dividers 30, 32 are connected by a joint 34 that permits the two dividers 30, 32 to move relative to one another to create the two positions. In the display position, the front divider 30 is pulled out away from the rear wall 26 of the display section 12. Such a position allows the bottom divider 32 of the convertible row 28 to be generally perpendicular to the rear wall 26 of the display section 12, thereby providing another level or row to the overall display section 12. Thus, in the configuration illustrated in FIG. 1, the top row of the display section 12 is able to display greeting cards 16 at its set or permanent level 14 and additional greeting cards 16 on a level provided by the convertible row 28. The front divider 30 of the convertible row 28 acts similarly to the front wall 22 of the row section 20, and serves to support the greeting card 16. The convertible row 28 will be further described herein below.

The display section 12 preferably also includes a plurality of divider or support clips 36. In the prior art, divider clips are clipped on the front piece (e.g., front wall 22) of a card row to horizontally separate different types of greeting cards 16. In the present invention, the divider clips 36 may also be used to support the convertible row 28 and maintain it in either the display or storage positions. Multiple embodiments of divider clips 36 of the present invention are illustrated and will be further described below.

When a convertible row 28 is no longer desired for use in displaying a row of greeting cards 16, it may be collapsed and the pushed back against the rear wall 26, as illustrated by the convertible rows 28 on the right side of the display section 12 of FIG. 1. The convertible rows 28 may be moved from the display position to the storage position by folding the convertible row 28 at the joint 34 and moving the front divider 30 back against the rear wall 26. This position and alternate embodiments are described in more detail below.

Turning now to FIG. 2, a cross-sectional, side elevation view of the card assembly apparatus 12 in FIG. 1 is shown. In this view, two convertible rows 28 are shown. The upper convertible row 28 is illustrated in the display position, with the bottom divider 32 generally perpendicular to the rear wall 26. As will be further discussed below, a proximal edge 38 of the bottom divider 32 of the convertible row 28 is rotatably received in a horizontal channel 40 in the rear wall 26 of the display section 12. The bottom divider 32 of the convertible row 28 supports the greeting card 16, thereby providing another row to the set permanent row or level 14 immediately below that is also displaying a greeting card 16. A portion of that greeting card 16 is displayed over the front wall 22 and a top edge 42 thereof rests against the front of the front divider 30 of the upper convertible row 28.

The upper divider clip 36, which is adjacent to the upper convertible row 28 in the display position, is in its open or support position. A movable portion 44 of the divider clip 36 extends downward and provides support for the bottom divider 32 of the convertible row 28. This serves to stabilize and support the convertible row 28 when displaying greeting cards 16.

The lower convertible row 28 of FIG. 2 is illustrated in the storage position. The bottom divider 32 of the convertible row 28 has been rotated downwardly and moved to an orientation where it is closer to parallel to the rear wall 26 of the display section 12, thereby allowing the convertible row 28 to collapse and rest against the back of the permanent row or level 14. By being collapsible, the convertible row 28, when not desired for displaying an additional row of cards 16, does not need to be removed from the display section 12. Such a configuration thus avoids the need to remove a divider and store it until an additional row is needed. Here, in the bottom portion of FIG. 2, only the set row of the display section 12, formed by the row section 20, is being used for displaying a greeting card 16.

When the convertible row 28 is in the storage position, the divider clip 36 adjacent to it is adjusted so that it presses against the convertible row 28, holding it in place against the rear wall 26 of the display section 12. Note that a divider clip 36 may be used adjacent a convertible row 28 whether it is in the display or storage position, and is adjusted accordingly As will be discussed in greater detail below, an adjustable divider clip, such as divider clip 36, allows for more flexibility when determining which position a convertible row 28 is to be used. One skilled in the art will appreciate that various embodiments of divider clips may be used, and will be discussed in more detail below.

Figure 3A:
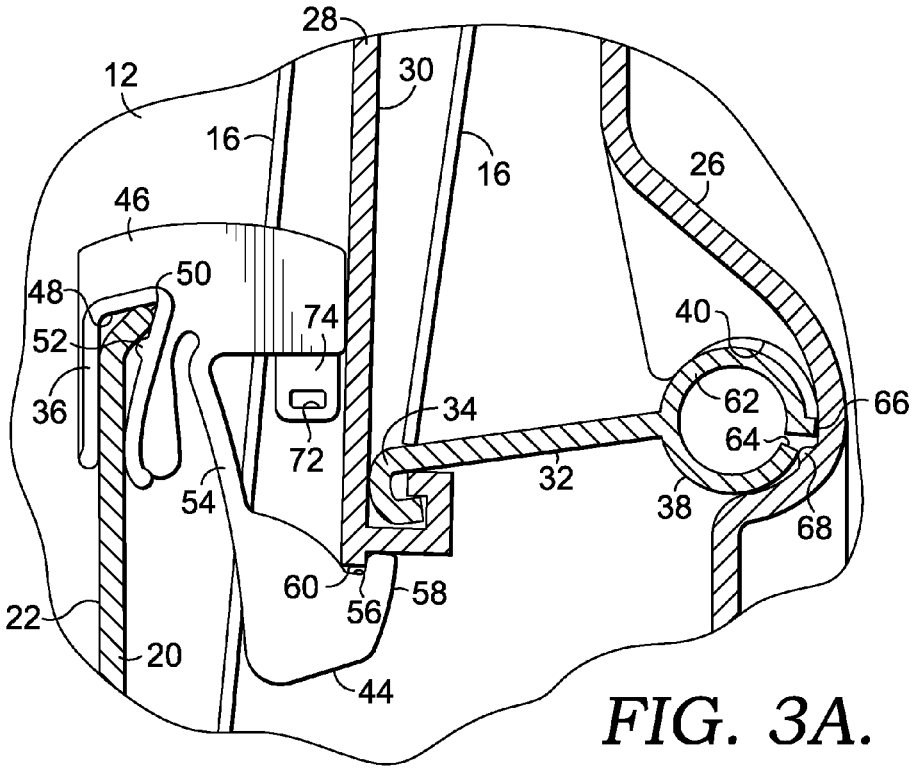
FIGS. 3A and 3B are enlarged, fragmentary views taken generally in the areas 3A and 3B of FIG. 2 and illustrate the cooperation between the divider piece and a clip.
Figure 3B:
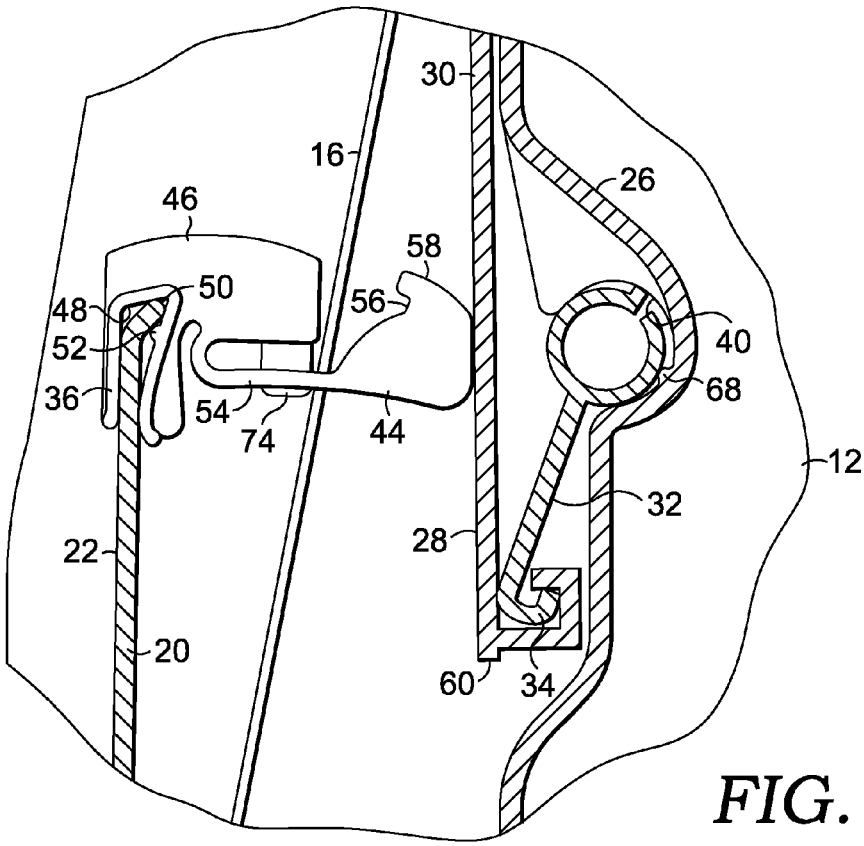

Referring now to FIGS. 3A and 3B, enlarged views of the divider clips 36 from FIG. 2 are provided, in accordance with embodiments of the present invention. In FIG. 3A, where the convertible row 28 is in the display position, the divider clip 36 is in its open or support position. The divider clip 36 has a body portion 46 with a notch 48 therein. The notch 48 is sized to receive an upper edge 50 of the front wall 22 of a row section 20, as illustrated. The notch 48 may also receive the upper edge 50 of the front divider 30 if the divider clip 36 is placed on the convertible row 28 when it is in its display position to separate cards 16 placed thereon. The notch 48 may also include a raised rib 52 therein to assist with retaining the divider clip 36 on the front wall 22 or front divider 30, as the case may be. While a notch 48 has been shown, one skilled in the art will appreciate that any method of attaching the divider clip 36 to the front of the display section 12 may be used in accordance with this invention.

The body portion 46 is connected with the movable portion 44 via an arm 54. The arm 54 is preferably flexible such that it may be bent between the illustrated support and hooked positions. In that regard, the divider clip 36 may be made of a plastic and formed by a molding process. In such an arrangement, the arm may be naturally biased to a position intermediate the illustrated support and hooked positions. In this way, the arm 54 provides lift and secure engagement to the convertible row 28 when it is in the support position.

To assist with secure engagement with the convertible row 28, the movable portion 44 is provided with a nock 56 in its outer periphery 58. The nock 56 is intended to receive a lower edge 60 of the front divider 30 of the convertible row 28, as illustrated in FIG. 3A. In this arrangement, the clip 36 holds the convertible row 28 in the display position by preventing downward and rearward movement of the front divider 30. Downward pressure on the bottom divider 32, caused by the weight of the front divider 30 and any greeting cards 16 placed in the convertible row 28, is transferred through the clip to the front wall 22. Further, the body portion 46 spaces the front divider 30 from the front wall 22 and prevents forward rotation of the front divider 30.

To further prevent unintended movement of the convertible row 28 from the display position to the storage position, friction arrangement is provided. In that regard, the proximal edge 38 of the bottom divider 32 is provided with a generally cylindrical tube portion 62. The tube portion 62 has a longitudinal slot 64 therein adjacent a stop flange 66. When the tube portion 62 is received in the channel 40 of the rear wall 26 of the display section 12, a longitudinal ridge 68 is received in the slot 64 when the bottom divider 32 is in a generally horizontal position, as illustrated in FIG. 3A and which corresponds with the convertible row 28 being in its display position. The ridge 68 in the slot 64 discourages rotational movement of the tube portion 62 in a direction where the ridge 68 is moved out of the slot 64, as such requires the tube portion 62 to be compressed, as illustrated in FIG. 3B. This is helpful when the convertible row 28 is first placed in the display position before the divider clips 36 can be hooked on to the bottom of the convertible row 28. The stop flange 66 discourages rotational movement of the tube portion 62 in a direction past that needed for the display position.

Figure 4A:
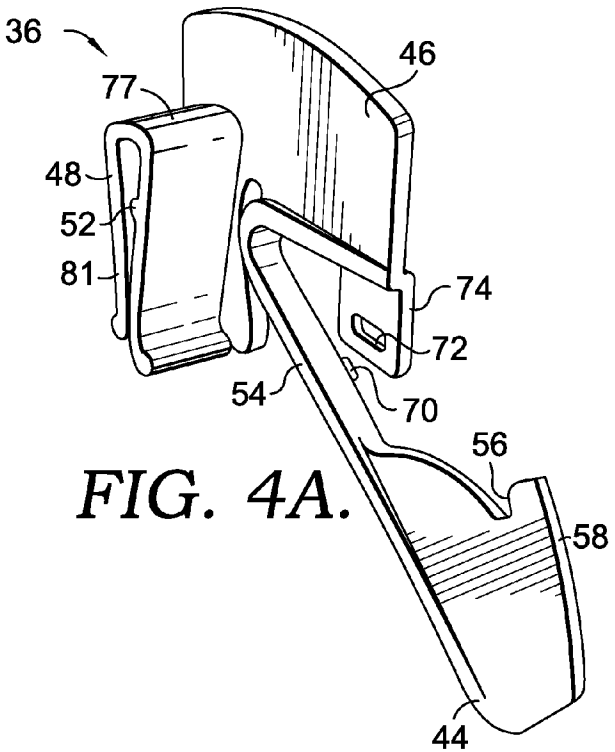
FIG. 4A is a perspective view of a dividing clip constructed in accordance with a first embodiment and illustrated in an open or support position.
Figure 4B:
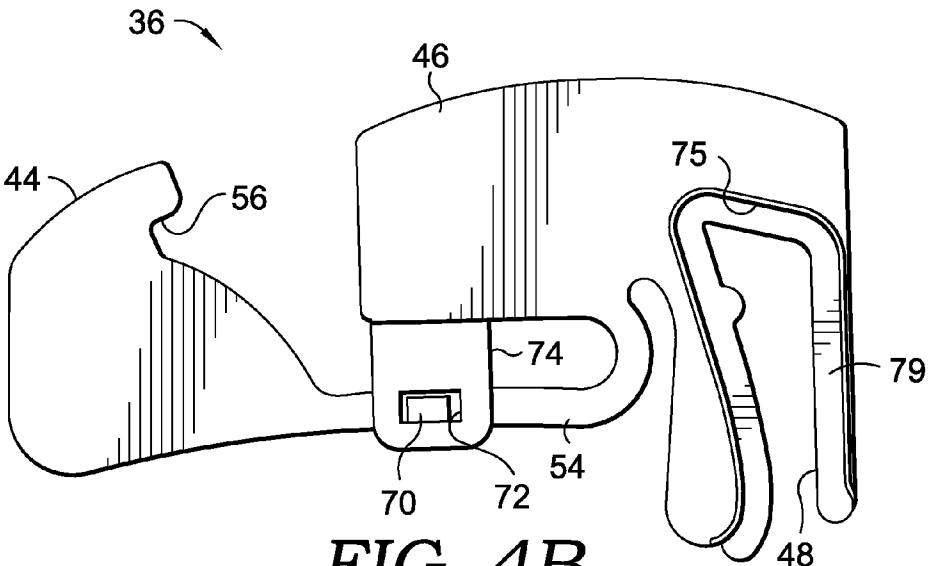
FIG. 4B is a side elevation view of the dividing clip of FIG. 4A in a hooked position.

In FIG. 3B, where the convertible row 28 is in the storage position, the divider clip 36 is in its hooked position. In this position, the arm 54 is generally perpendicular to the rear wall 26 of the display section 12 and preferably presses against the convertible row 28 to keep it collapsed and in the storage position. To maintain the divider clip 36 in the hooked position, the divider clip 36, in this embodiment, includes a projection 70 that extends outwardly from a side of the arm 54 and is received in an aperture 72 of a tab 74 that extends from the body portion 46 of the divider clip 36, as best illustrated in FIGS. 4A and 4B. Alternate embodiments of divider clips are illustrated and will be described below.

FIGS. 4A and 4B illustrate alternate views of the first embodiment of the divider clip 36. In this illustrated embodiment, the divider clip 36 comprises a singular piece of material. FIG. 4A shows the divider clip 36 is in its open or support position that corresponds with the convertible row 28 being in the display position, as discussed above. FIG. 4B shows the divider clip 36 is in its hooked position that corresponds with the convertible row 28 being in the in a storage position. As can be seen, the projection 70 is received in the aperture 72 to secure the movable portion 44 in a location to abut the front divider 30 of a convertible row 28 to maintain it in a storage position.

The divider clip 36 may also be provided with a recess portion 75 in the body portion 46 adjacent to and of a corresponding shape as the notch 48. As illustrated in FIG. 4A, the notch may be part of a clipping member 77 that extends laterally outward from the body portion 46. The recess portion is adjacent a proximal end 79 of the clipping member and is designed to receive a distal end 81 of a clipping member 77 of another divider clip 36 placed adjacent thereto. This arrangement allows for a plurality of divider clips 36 to be coupled together for easy storage and to support the ease/speed of installation of the divider clips 36 during a reset/conversion of a display or a reduction/increase in the number of rows.

Figure 5:
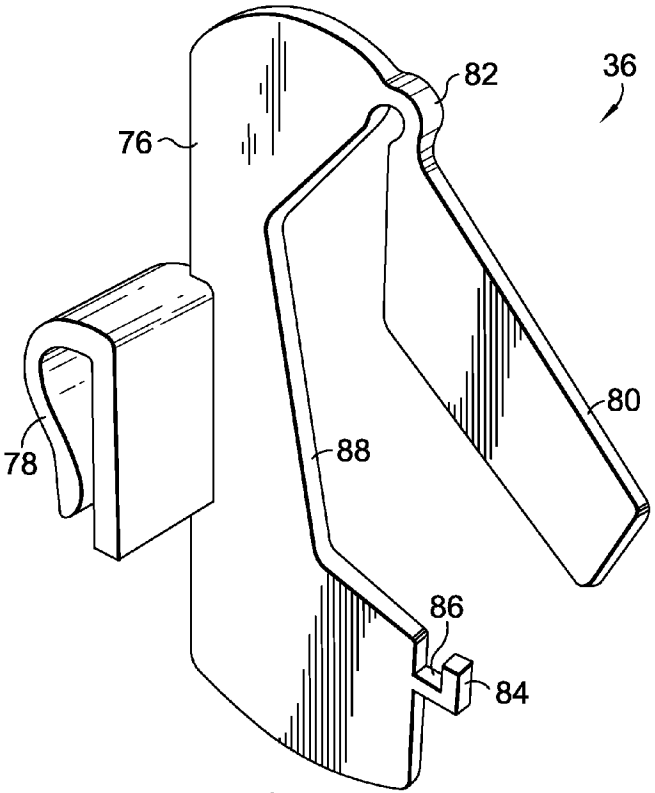

Referring now to FIG. 5, an alternative embodiment of a divider clip 36 is illustrated, in accordance with the present invention. The divider clip 36 has a body portion 76 with a clipping member 78 for attaching the divider clip 36 to a front wall 22 or front divider 30. The divider clip further includes an adjustable portion 80, which connects to the body portion 76 of the divider clip 502 via a bend 82. The bend 82 functions similar to the arm 54 and biases the adjustable portion 80 to the position illustrated. The divider clip 36 further includes a hook 84 extending from a lower portion of the body portion 76 and having a notch 86.

In this embodiment, the divider clip 36 is illustrated in a position for use when the convertible row 28 is in the storage position. The adjustable portion 80 extends away from the body portion 76 of the divider clip 36 to press against the front divider 30, which itself rests against the rear wall 26 of the display section 12, as described above. When a convertible row 28 is used in the display position, the bend 82 will flex, and the adjustable portion 80 will be moved back into a correspondingly shaped cutout 88. The lower edge 60 of a front divider 30 will then rest or otherwise be secured in the notch 86 of the hook 84.

Figure 6C:
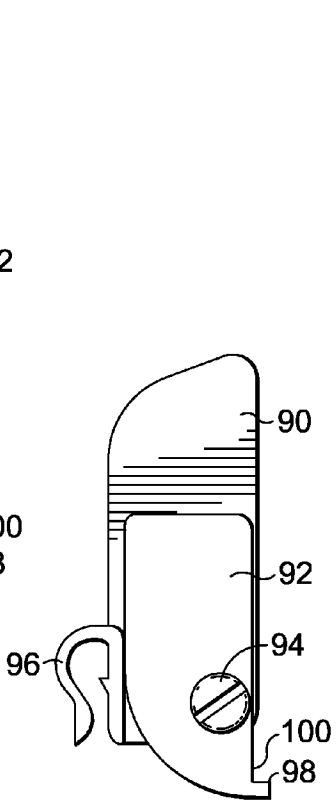
FIGS. 6A-6C illustrate a third possible embodiment of a dividing clip of the present invention.
Figure 6A:
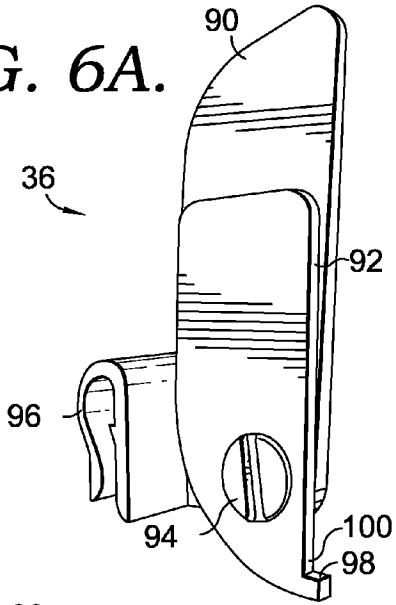
Figure 6B:
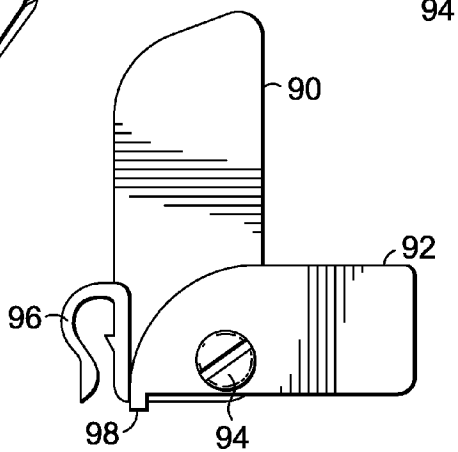

Turning now to FIGS. 6A-6C, a third possible embodiment of a divider clip 36 is shown, in accordance with the present invention. Here, the divider clip 36 includes a fixed portion 90 and a rotatable portion 92. These portions 90, 92 are connected at joint 94, about which the rotatable portion 92 pivots. The fixed portion 90 includes a clipping mechanism 96 for attaching the clip 36 to a front wall 22 or front divider 30. When a convertible row 28 is in a display position, the divider clip 36 oriented to the position illustrated in FIGS. 6A and 6C, where the rotatable portion 92 is generally parallel to the fixed portion 90. In this arrangement, a ledge 98 extends outwardly from a lower edge 100 of the rotatable portion 92 and is used to support the lower edge 60 of the front divider 30 of the convertible row 28, as discussed above with respect to FIG. 3A. FIG. 6B illustrates the rotatable portion 92 rotated to be generally perpendicular to the fixed portion 90, which is the position of the divider clip 36 when the convertible row 28 is in a storage position.

Figure 7A:
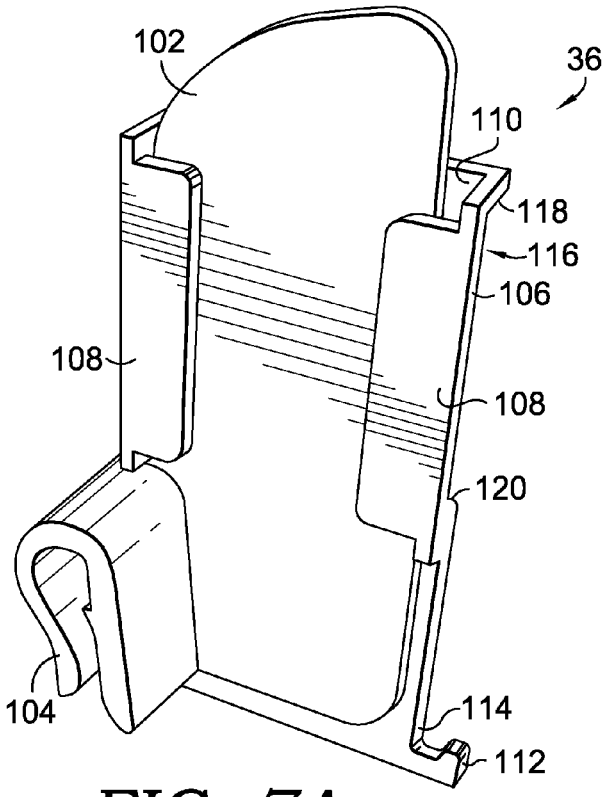
Figure 7B:
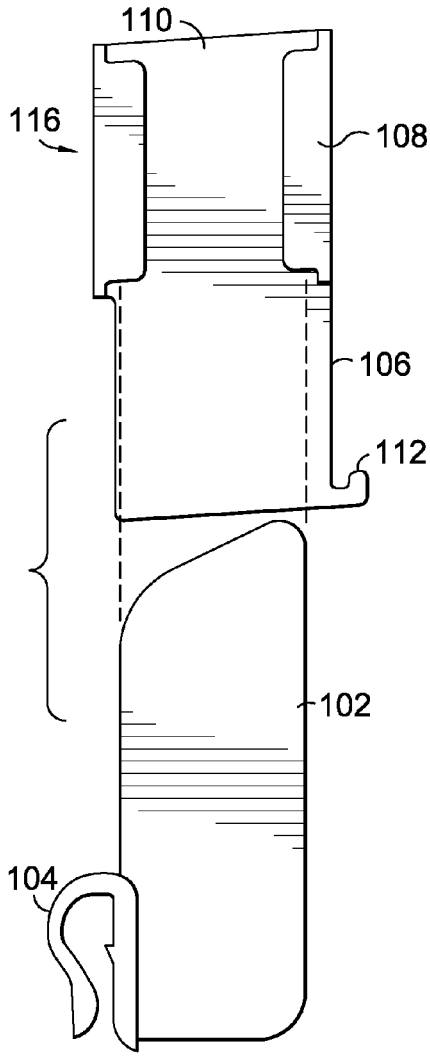
Figure 7C:
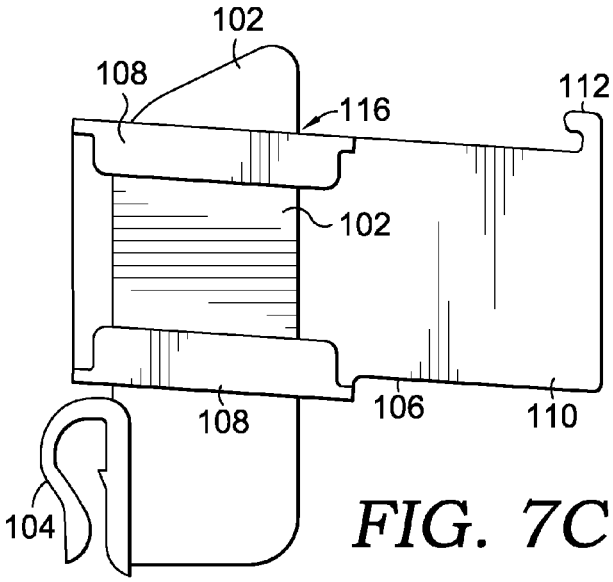

FIGS. 7A-7C illustrate a fourth possible embodiment of a divider clip 36, where the divider clip includes two separate pieces: a clipping portion 102, which includes a clipping mechanism 104, and an adjustable portion 106, which slides on the clipping portion 102. Flaps 108 secure the fixed portion 102 against a back 110 of the adjustable portion 106. When a convertible row 28 is in a display position, the divider clip 36 is oriented to the configuration illustrated in FIG. 7A. Here, both the clipping portion 102 and the adjustable portion 106 are generally parallel to each other. A ledge 112 extends outwardly from a lower edge 114 of the adjustable portion 106 and is used to support the lower edge 60 of the front divider 30 of the convertible row 28, in a manner similar to that discussed above with respect to FIG. 6A. The ledge 112 thereby supports the convertible row 28 and works to maintain it in the display position. FIG. 7B illustrates how these pieces 102, 106 fit together when used in connection with a convertible row 28 in the display position.

When the convertible row 28 is in a storage position, the divider clip 700 may be reconfigured to the arrangement illustrated in FIG. 7C. In this illustrated example, the adjustable portion 106 is secured to the clipping portion 102 by rotating it approximately 90° and receiving the clipping portion 102 in a transverse opening 116 in the adjustable portion 106 that is defined by the flaps 108 and sides 118 and 120 (FIG. 7A).

Many variations can be made to the illustrated embodiments of the present invention without departing from the scope of the present invention. Such modifications are within the scope of the present invention. For example, the convertible rows 28 can span the entire width of the display section 12. Similarly, while the joint 34 is illustrated as constructed in the illustrated manner, other versions of the joint that permit movement between the front divider 30 and the bottom divider 32 (such as a hinge type mechanism) are possible and within the scope of the present invention. Additionally, the display sections 12 can be molded with features or apertures in the rear of the section to facilitate coupling of the display section 12 to a display fixture. It should be noted that the increase of the row depth when a convertible row 28 is collapsed allows for the display of product having an increased product depth. Further, while the present invention has been described in connection with the display of greeting cards, the present invention is not limited to such a narrow use. Non-card products can be displayed as well. Other modifications would be within the scope of the present invention.

From the foregoing it will be seen that this invention is one well adapted to attain all ends and objects hereinabove set forth together with the other advantages which are clear following the complete disclosure above and which are inherent to the methods and apparatuses described herein. It will be understood that certain features and subcombinations are of utility and may be employed without reference to other features and subcombinations. This is contemplated by and is within the scope of the invention.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

The invention claimed is:

1. A divider clip for separating greeting cards within a row of a display section by receipt on a front wall thereof and for periodically supporting a convertible row, the divider clip comprising:

a fixed portion and a rotatable portion, wherein the fixed portion includes a clipping mechanism to couple the divider clip with the front wall of the display section, wherein the fixed portion is fixed in a generally vertical orientation when the clipping mechanism is coupled with the front wall of the display section, wherein the rotatable portion is movably coupled with the fixed portion at a joint, wherein the rotatable portion is movable from a generally vertical orientation in a first position to a generally horizontal orientation in a second position with respect to the fixed portion, and wherein the rotatable portion is generally parallel to the fixed portion in the first position and is generally perpendicular to the fixed portion in the second position.

2. The divider clip of claim 1, wherein the joint includes a pivot point around which the rotatable portion pivots between the first and second positions.

3. The divider clip of claim 1, wherein the pivot point is a bolt used to couple the rotatable portion to the fixed portion.

4. The divider clip of claim 1, wherein the fixed portion is a planar member having a length dimension oriented in a vertical orientation, wherein the rotatable portion is a planar member having a length dimension, and wherein the rotatable portion is coupled adjacent and parallel to the fixed portion.

5. The divider clip of claim 4, wherein the clipping mechanism is an upside down U-shaped member having a width dimension and wherein the clipping mechanism has a downwardly facing opening to receive an upper edge of a generally vertical front wall of a display section.

6. The divider clip of claim 5, wherein the width dimension of the upside down U-shaped member is oriented in a horizontal orientation, wherein the clipping member is coupled with a peripheral edge of the fixed member, and wherein the planar fixed member is perpendicular to the width dimension of the upside down U-shaped member.

7. The divider clip of claim 5, wherein the upside down U-shaped member includes an inner wall, wherein the inner wall includes a raised rib thereon to assist with retaining the divider clip on the display section when clipped thereon, and wherein the raised rib is perpendicular to the planar fixed member.

8. The divider clip of claim 4, wherein the rotatable portion includes a peripheral edge, wherein the peripheral edge includes a ledge extending outwardly from a lower portion of the edge when the rotatable portion is oriented in a vertical orientation, whereby the ledge presents a support upon which a convertible row may rest when the rotatable portion is in the first position.

9. A divider clip for separating greeting cards within a row of a display section and for supporting an adjacent convertible row when in a use position, the divider clip comprising:

a generally vertical fixed portion having a clipping mechanism with a transverse, downwardly facing opening for receipt of an upper edge of a front wall of a row of the display section; and a rotatable portion having a ledge extending outwardly therefrom, wherein the rotatable portion is movably coupled with the fixed portion at a joint, wherein the rotatable portion is movable from a first position, where the rotatable portion is generally vertical and the ledge extends generally horizontally therefrom for supporting an adjacent convertible row when in a use position, to a second position, where the rotatable portion is generally horizontal and the ledge extends generally downwardly.

10. The divider clip of claim 9, wherein the clip has an overall width dimension of a first size when the rotatable portion is in the first position and wherein the clip has an overall width dimension of a second size when the rotatable portion is in the second position, wherein the overall width dimension of the first size is less than the overall width dimension of the second size, whereby the clip is wider when the rotatable portion is in the second position for holding an adjacent convertible row in a closed position when the clip is positioned on a front wall and the rotatable portion is in the second position.

11. A divider clip for separating greeting cards within a row of a display section and for supporting an adjacent convertible row when in a use position, the row having a front wall in a generally vertical orientation and having an upper edge upon which the divider clip may be selectively received, the divider clip comprising:

a generally planar fixed portion having a clipping mechanism coupled therewith having an opening therein for selectively receiving the upper edge of the front wall of the row of the display section to couple the divider clip thereto, the fixed portion having a longitudinal dimension oriented in a generally vertical orientation, wherein the opening has a width dimension, and wherein the width dimension of the opening is perpendicular to the planar fixed portion, whereby the fixed portion is perpendicular to the front wall of the row when it is coupled therewith by receipt of the upper edge of the front wall in the opening of the clipping mechanism; and a generally planar rotatable portion rotatably coupled with the fixed portion at a joint, wherein the planar fixed portion and the planar rotatable portion are parallel to each other, wherein the rotatable portion is movable from a first generally vertical position, where longitudinal axes of the fixed and rotatable portions are parallel to each other, to a second generally horizontal position, where the longitudinal axes of the fixed and rotatable portions are perpendicular to each other.

12. The divider clip of claim 11, wherein the rotatable portion has a peripheral edge with a ledge extending outwardly from a lower portion thereof, wherein the ledge extends generally horizontally outwardly to support an adjacent convertible row when the rotatable portion is in the first position, and wherein the ledge extends generally downwardly when the rotatable portion is in the second position.

* * * * *